United States Patent [19]

Spector

[11] Patent Number: 4,687,203

[45] Date of Patent: Aug. 18, 1987

[54] SCRATCH AND SMELL GAME

[76] Inventor: Donald Spector, 380 Mountain Rd., Union City, N.J. 07087

[21] Appl. No.: 863,561

[22] Filed: May 15, 1986

[51] Int. Cl.[4] ..... A63F 9/10

[52] U.S. Cl. ..... 273/157 R; 434/333; 434/346; 434/347

[58] Field of Search ..... 273/156, 157 R; 434/333, 345, 346, 347

[56] References Cited

U.S. PATENT DOCUMENTS

| | | | |
|---|---|---|---|
| 1,735,456 | 11/1929 | Garman | 273/157 R X |
| 1,972,206 | 9/1934 | Thomay | 273/157 R |
| 3,570,139 | 3/1971 | Ladd et al. | 434/346 |
| 4,243,224 | 1/1981 | Spector | 273/157 R |
| 4,487,585 | 12/1984 | Goldwasser | 434/346 X |

*Primary Examiner*—Anton O. Oechsle
*Attorney, Agent, or Firm*—Michael Ebert

[57] ABSTRACT

A scratch and smell game for pre-school children which makes use of a playing board on whose front face is printed drawings of different fruits or other odor-producing objects, each having a characteristic smell. At a site adjacent each fruit on the front face is a removable chip seated in a cutout in the board and forming a part of the board, the chips all having the same geometry. Coated on the front face of each chip is a layer of rupturable capsules containing a fragrance whose smell matches that of the particular fruit adjacent thereto. Printed on the rear face of the board are drawings of the same fruits, portions of these printed drawings being included on the rear faces of the chips so that the chips are necessary to complete the drawings. In playing the game, the player first removes all chips from the board and then shuffles them so that their proper sites on the front face of the board are no longer known. He then scratches each chip; and after smelling the resultant fragrance, places the chip in the cutout at that site on the front face of the board which is adjacent the fruit which he believes gives off the same smell. After all chips are scratched and placed, the player turns over the board to examine the drawings on the rear face thereof. The player wins the game only if all of the drawings on the rear face are properly completed by the chips.

9 Claims, 5 Drawing Figures

SCRATCH AND SMELL GAME

BACKGROUND OF INVENTION

1. Field of Invention

This invention relates generally to a pre-school or primary school teaching device in the form of a puzzle or game which exercises both the visual and olfactory senses of the player, and more particularly to a game that makes use of a playing board having removable chips therein seated in cutouts, one surface of each chip being coated with a layer of rupturable capsules filled with a fragrance whose smell matches the characteristic smell of an odoriferous object, a drawing of which is printed on the board.

2. Status of Prior Art

Smell is that special sense which enables an individual to perceive and distinguish the odors of various substances or objects. The organ of smell is made up of olfactory cells situated in the mucous membrane of the upper portion of the nasal cavity. The hair-like free ends of the cells are stimulated by odors and scents entering the nasal cavity, the nerve fibers of the cells sending impulses through the nervous system to the brain where the odor or scent is registered.

The sense of smell in modern man has been dulled by various factors such as excessive smoking and drinking; but pre-school children remain highly responsive to odors. Taste is often confused with smell and in many instances substances supposedly tasted are without taste and are really smelled. This may account for the sharp reaction of children to unpleasant medicines which adults find less disagreeable. Yet the olfactory sensitivity of pre-school children, which is far greater than that possessed by most adults, is rarely exploited in educational or play activity.

In dealing with pre-school or primary school children there is no clear line of demarcation between play and teaching activity, for teaching is best carried out in a play or game mode. For example, in teaching a child the relationship between objects and words, one can create a game in which the child is asked to match word-bearing cards with pictures of objects. Thus, in the game disclosed in the patent to Aberge et al., U.S. Pat. No. 3,172,214, the word "milk" is associated with a picture of a milk bottle, and the word "frog" with a picture of this animal.

The concept of matching underlies many of the teaching devices and games designed for pre-school children. Thus, the patent to Levin, U.S. Pat. No. 3,349,503, matches up objects and colors. Albee, U.S. Pat. No. 2,659,163, matches up geometric shapes with colors; while White, U.S. Pat. No. 3,715,816, matches up animals with their natural food. The Ladd et al., U.S. Pat. No. 3,570,139, discloses a book made up of sheets having coatings thereon which when scratched give off particular odors. In Ladd, after a coating is scratched and smelled, the player places a picture of a selected object such as peppermint candy against the scratched coating which the player believes gives off the odor of the object.

But lacking in these prior art patents is a game, puzzle or educational device in which odor, color and geometric form are coordinated in a selective matching procedure having a high degree of play and educational value.

In my prior U.S. Pat. No. 4,243,227, there is disclosed a game for pre-school or primary school children that makes use of a playing board having printed thereon at distinct positions pictures of different odoriferous objects such as fruits having characteristic smells. Superimposed on each pictured object is an identifier constituted by a major circle and a minor circle concentric therewith, the circles being radially divided into colored segments. Each identifier has a distinctive color pattern that differs from every other identifier. The periphery of the minor circle is scored to define a punchout disc, the surface of which is coated with a myriad of minute, rupturable capsules containing an odor-producing substance whose smell is the characteristic odor of the related object.

The discs are removed from the playing board to create sockets therein, each of which is surrounded by a major circle ring whose color pattern matches that of the removed disc. The group of discs serve as the play elements of the game, the player being required to select a play element and to scratch and smell its surface. He then places the element in the ring socket of the pictured object which he believes gives off the same odor. The correctness of his choice is confirmed if there is a match between the color pattern of the element and that of the socket ring.

My prior game exploits only one face of the playing board, the other face being wasted.

SUMMARY OF INVENTION

In view of the foregoing, the main object of this invention is to provide a smell and scratch game which makes use of both faces of a playing board and which serves to exercise both the olfactory and visual senses of the player.

A significant feature of a game in accordance with the invention is that it involves matching of both smells and visual patterns, so that the game has a high order of play and educational value and serves to sustain the interest of the player.

More particularly, an object of the invention is to provide a game board having printed on the front face thereof drawings of various objects such as fruit having characteristic odors, the board having formed therein a group of removable play elements or chips which when scratched exude distinct odors which correspond to the respective characteristic odors of the printed objects, the player being required, after having removed all the chips from the board and shuffled them to then return the chips to the board so as to match each chip with the appropriate object, a proper match being visually indicated on the rear face of the board.

Also an object of the invention is to provide a game of the above type which may be manufactured at low cost.

Briefly stated, these objects are attained in a scratch and smell game for pre-school children which makes use of a playing board on whose front face is printed drawings of different fruits or other odor-producing objects, each having a characteristic smell. At a site adjacent each fruit on the front face is a removable chip seated in a cutout in the board and forming a part of the board, the chips all having the same geometry. Coated on the front face of each chip is a layer of rupturable capsules containing a fragrance whose smell matches that of the particular fruit adjacent thereto. Printed on the rear face of the board are drawings of the same fruits, portions of these printed drawings being included on the rear faces of the chips so that the chips are necessary to complete the drawings. In playing the game, the player first removes all chips from the board and then shuffles them so that their proper sites on the front face of the board are no longer known. He then scratches each chip; and after smelling the resultant fragrance, places the chip in the cutout at that site on the front face of the board which is adjacent the fruit which he believes gives off the same smell. After all chips are scratched and placed, the player turns over the board to examine the drawings on the rear face thereof. The player wins the game only if all of the drawings on the rear face are properly completed by the chips.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
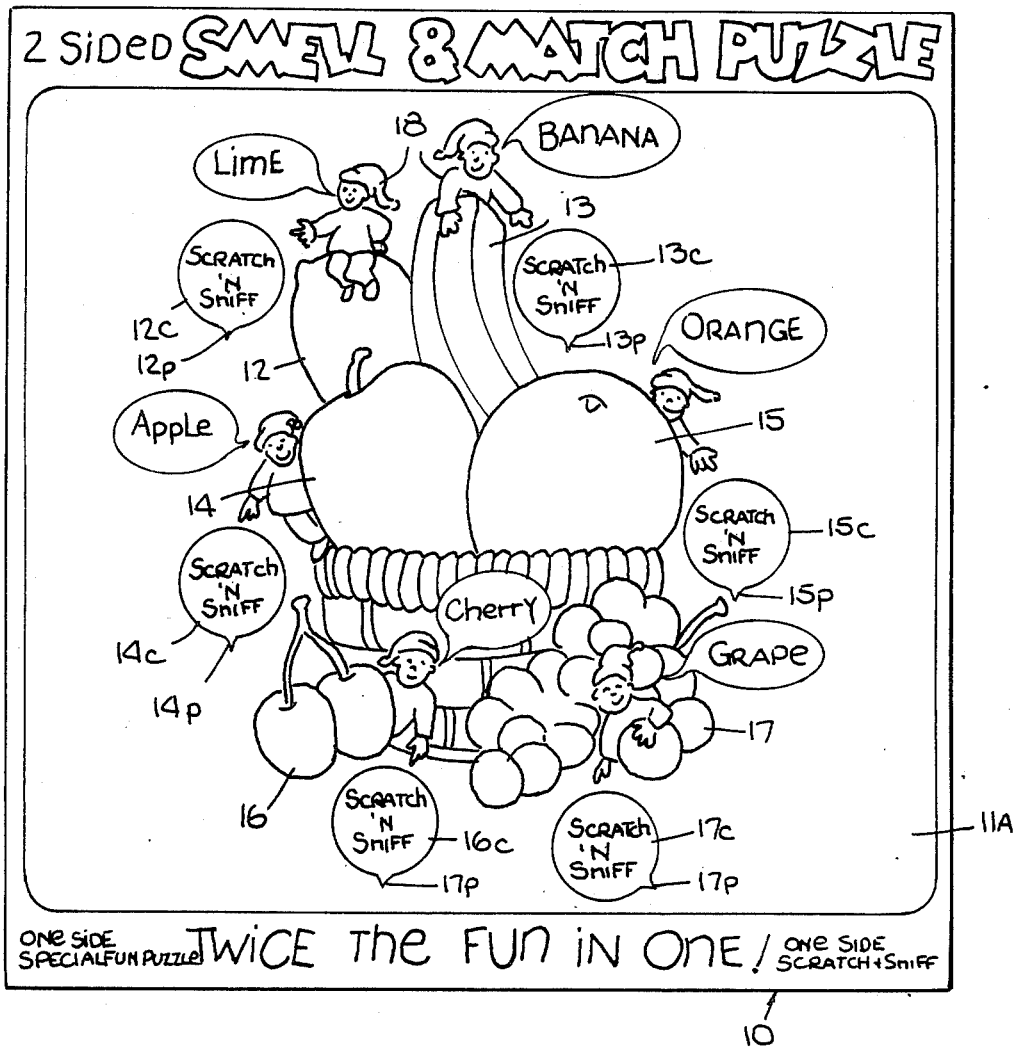
FIG. 1 shows the front face of a playing board in accordance with the invention.

Referring now to the figures of the drawing, FIG. 1 shows the front face of a playing board which may be fabricated of a panel 10 of good grade cardboard having laminated thereto front and rear face sheets 11A and 11B of glossy printable paper. Printed on front face 11 at various positions thereon are drawings or pictures of different odoriferous objects. In the sample illustrated, these are different fruits; namely, a lime 12, a banana 13, an apple 14, an orange 15, a cluster of cherries 16 and a cluster of grapes 17. Each of these fruits has a characteristic smell or scent which is different from those exuded by the other fruits. In practice, instead of fruit, one could show various flowers, vegetables, or even different varieties of cooked foods.

Sitting atop or standing beside each fruit in FIG. 1 is a gnome-like or comic strip figure 18 who, as represented by an associated balloon, appears to be calling out the name of the fruit. Thus, the figure seated on the lime is calling out LIME, and the figure next to the orange is calling out ORANGE.

Figure 3:
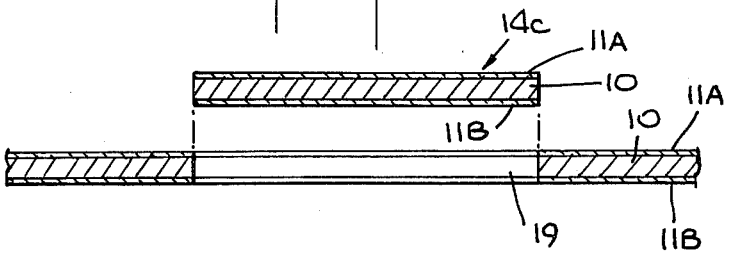
FIG. 3 is a section taken through one cutout in the board showing the chip removed therefrom.
Figure 4:
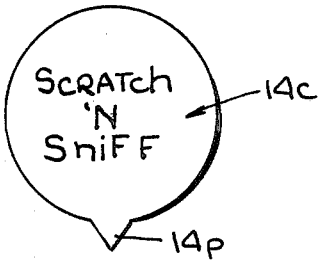
FIG. 4 shows the front face of one of the chips.

Adjacent each figure is a removable chip or playing element which is seated in a cutout in the board and which has printed on its front face SCRATCH & SNIFF. These chips may be formed by die cutting the board. Thus, associated with fruits 12 to 17 are chips 12C to 17C. As shown in FIG. 3, chip 14C fits into a cutout 19 in the playing board. And, as shown in FIG. 4, each chip, such as chip 14C, is disc-shaped and is provided with a triangular projection $\mathbf{14}_p$ which fits into a corresponding triangular notch in the cutout so as to properly orient the chip when it is seated in the cutout. The importance of this orientation will be later explained.

The front face of each chip is coated with a myriad of minute, rupturable capsules filled with an odor-producing substance whose scent corresponds to or simulates the odor of the related pictured object. Thus, chip 13C associated with banana 13 has a coating which, when the capsules are ruptured by scratching, will exude a banana-like odor.

Coatings of this type in a broad spectrum of odors which simulate virtually every known natural odor or scent are available commercially from such manufacturers as the 3M Corporation. These coatings or layers can be applied by printing techniques to the board. Because of the high density of the microscopic capsules in the coating, it may be scratched over and over again and still continue to give off the desired odor with each scratching. The game, therefore, has an almost indefinite life.

Figure 2:
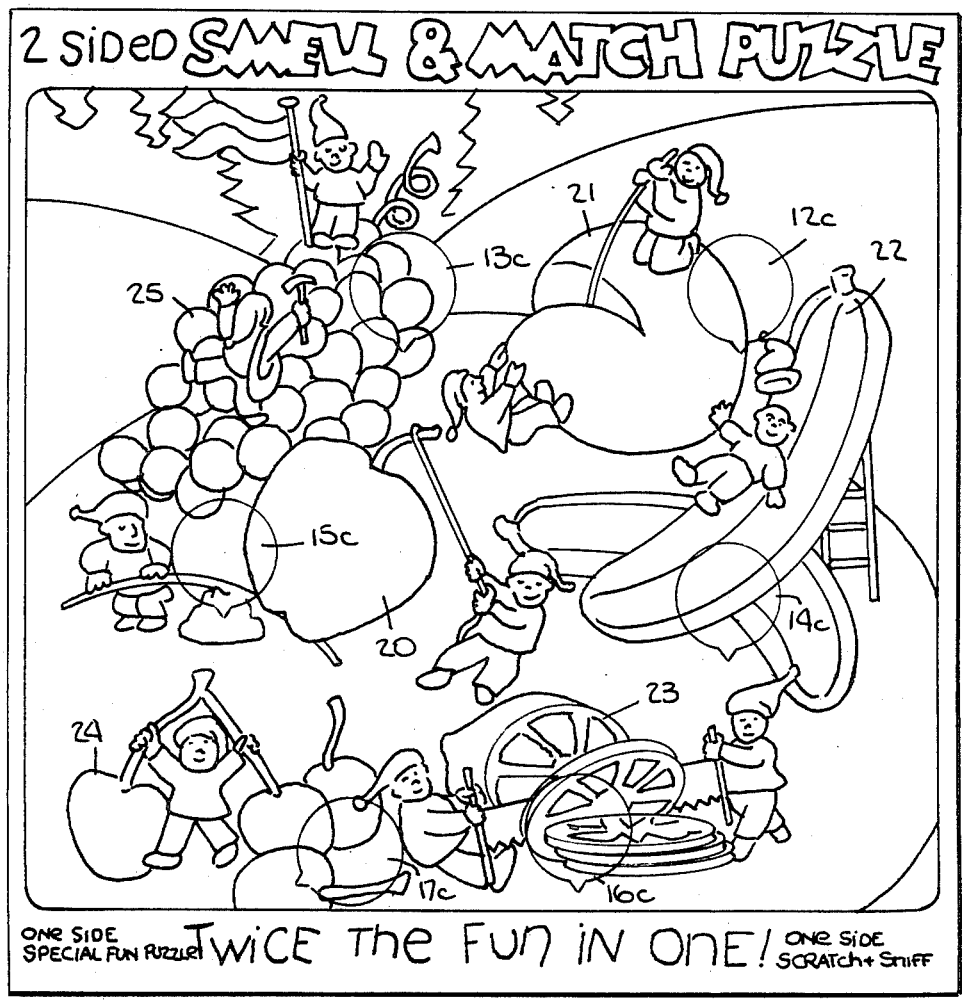
FIG. 2 shows the rear face of the board.

Referring now to FIG. 2 which shows the rear side 12 of the board, it will be seen that printed thereon are drawings of the same fruits, but the representations of these fruits are different from those on the front face and their placement on the board is also different. Thus, on the rear face, we find represented an apple 20, an orange 21, a banana 22, a lime 23, a cluster of cherries 24 and a cluster of grapes 25. However, the chip positions on the board are unchanged.

However, the rear faces of the chips are so printed that each face includes some portion of the fruits pictured on the rear face. Thus, chip 12C has printed thereon a portion of grapes 25, chip 13C includes a portion of orange 21, chip 14C includes a portion of apple 20, as well as a portion of grapes 25, and so on.

Figure 5:
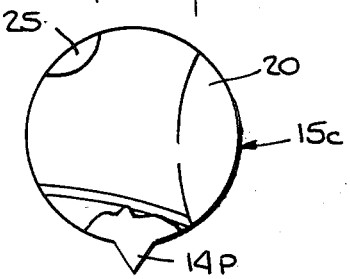
FIG. 5 shows the rear face of the same chip.

Thus, as shown separately in FIG. 5, on the rear face of chip 15C one sees a portion of apple 20 and a portion of grapes 25. All of the chips will fit into any one of the cutouts; but unless the selective placement of the chips corresponds to that shown in FIG. 2, the chips will not complete the pictures of the fruits, and if misplaced, will render the pictures incomplete.

In playing the game, the player first removes all chips from the cutouts so that all the cutouts are then vacant. He then places the playing board on a table or other surface with the front face up and the rear face hidden. And he then shuffles the chips to thoroughly mix them up so that there is no way by visual observation of knowing where to return the chips to their original positions.

The player now selects a chip and scratches its front face to release the fragrance, and he smells it to determine its identity. He then, on the basis of his judgment as to the smell, places the chip in the cutout adjacent that fruit which, in his opinion, has the same characteristic odor. If, therefore, when scratching, say, chip 12C, he thinks its odor is that of an apple, he places it in the cutout adjacent the apple; but if it smells to him like a grape, he places it adjacent the grapes.

When the player has scratched and smelled all of the chips and placed them in the cutouts on the basis of his judgment as to their identity, the game is over. And to determine whether he has correctly identified all of the smells, he turns over the board and examines the rear face thereof. If all of the fruit pictures on the rear face are complete, then the player has won the game; but if the chips have not all been properly placed, then not all the pictures are complete, and the player loses.

The game can be played competitively, and two or more players can successively play the same game and the results compared. Thus, one player may succeed in completing all pictures, another may only complete some of the pictures, and a third may render all of the pictures incomplete, so that the first player wins, the second comes in second, and the third comes in last.

While there has been shown and described a preferred embodiment of a scratch and smell game in accordance with the invention, it will be appreciated that many changes and modifications may be made therein without, however, departing from the essential spirit thereof.

I claim:

1. A scratch and smell game comprising a playing board having front and rear faces, said front face having printed thereon at distinct positions representations of different natural objects each having a characteristic smell which differs from the smell of the other object, said board being provided with removable playing chips all having the same geometry seated in cutouts in the board at sites adjacent the respective natural objects, the front face of each chip being coated with a layer of rupturable minute capsules containing a substance which when the layer is scratched to rupture the capsules exudes an odor that simulates that of the adjacent object, the rear face of the board having printed thereon representations of different objects, a portion of each representation appearing on the rear face of a respective chip, whereby when in playing the game the chips are removed from their cutouts, scratched and smelled, and each chip is then returned to that site which the player believes is adjacent a natural object whose characteristic smell is simulated by the chip, the player wins the game only if upon examining the rear face he then finds that all object representations thereon have been completed by the portions thereof on the chips.

2. A game as set forth in claim 1, wherein said board has faces formed by printable paper sheets laminated thereto.

3. A game as set forth in claim 1, wherein each chip has a disc-shaped form with a lateral extension lug, and said cutouts have the same geometry, whereby the orientation of the chip, when returned to a cutout, is always the same.

4. A game as set forth in claim 1, wherein said natural objects are fruits.

5. A game as set forth in claim 1, wherein said natural objects are vegetables.

6. A game as set forth in claim 1, wherein said natural objects are flowers.

7. A game as set forth in claim 1, wherein the objects on the rear face are the same as those on the front face but in different representations thereof and at different positions from those on the front face.

8. A game as set forth in claim 1, wherein each object on the front face is identified by a legend.

9. A game as set forth in claim 8, wherein said legend appears in a balloon issuing from a figure adjacent the object.

* * * * *